US005320692A

United States Patent [19]

Burdette et al.

[11] Patent Number: 5,320,692

[45] Date of Patent: Jun. 14, 1994

[54] SOLID FUEL RAMJET COMPOSITION

[75] Inventors: George W. Burdette; Gary W. Meyers, both of Ridgecrest, Calif.

[73] Assignee: The United States of America as represented by the Secretary of the Navy, Washington, D.C.

[21] Appl. No.: 329,621

[22] Filed: Nov. 25, 1981

[51] Int. Cl.[5] ..... C06B 45/10

[52] U.S. Cl. ..... 149/19.9; 149/87; 60/207

[58] Field of Search ..... 60/207; 149/19.2, 19.9, 149/87

[56] References Cited

U.S. PATENT DOCUMENTS

| | | | |
|---|---|---|---|
| 2,530,489 | 11/1950 | Van Loenen | 149/87 |
| 2,926,613 | 3/1960 | Fox | 149/87 |
| 2,995,431 | 8/1961 | Bice | 52/0.5 |
| 3,019,145 | 1/1962 | Whitby | 149/87 |
| 3,122,429 | 2/1964 | Toulmin | 149/87 |
| 3,133,842 | 5/1964 | Kuehl | 149/19 |
| 3,462,952 | 8/1969 | D'Alelio | 149/19 |
| 3,577,289 | 5/1971 | Morrell | 149/19 |
| 3,598,668 | 8/1971 | Sayles | 149/19 |
| 3,702,354 | 11/1972 | Diebold et al. | 264/3 D |
| 3,726,729 | 4/1973 | Pierce | 149/19 |
| 3,761,330 | 9/1973 | Lou et al. | 149/20 |
| 3,986,909 | 10/1976 | Macri | 149/19.9 |
| 3,986,910 | 10/1976 | McCullough et al. | 149/19.9 |
| 4,133,173 | 1/1979 | Schadow | 60/207 |
| 4,202,668 | 5/1980 | Sippel et al. | 44/7.3 |
| 4,332,631 | 6/1982 | Herty et al. | 149/19.2 |
| 4,392,895 | 7/1983 | Reed et al. | 149/19.3 |
| 4,729,317 | 3/1988 | Burdette et al. | 149/19.9 |

*Primary Examiner*—Edward A. Miller

*Attorney, Agent, or Firm*—Thomas H. Hennen; Melvin J. Sliwka; John L. Forrest, Jr.

[57] ABSTRACT

A ramjet solid fuel composed of Hydroxyl terminated polybutadiene aluminum, magnesium, and boron carbide is described. The high volumetric heating value fuel of the present invention significantly increases the distance range of missiles.

3 Claims, No Drawings

SOLID FUEL RAMJET COMPOSITION

BACKGROUND OF THE INVENTION

This invention relates to ramjet fuels and more particularly to those solid ramjet fuels which are composed of hydroxyl terminated polybutadiene (HTPB).

Though the performance of presently available standard solid fuel for ramjets containing HTPB is considered adequate, it is highly desirable to have ramjet solid fuel compositions of increased performance, as the range of missiles would be significantly increased and they could be deployed for tactical air launched missiles.

OBJECTS OF THE INVENTION

It is, therefore, an object of this invention to provide a novel ramjet solid fuel composition.

A further object of this invention is to increase the distance range of weapons using solid ramjet fuels.

It is still another object of this invention to provide additives which would increase the volumetric heating value of HTPB.

BRIEF SUMMARY OF THE INVENTION

These and still further objects of the present invention are achieved, in accordance therewith, by providing a ramjet solid fuel composition which contains hydroxyl terminated polybutadiene and a combination of additives, aluminum, magnesium and boron carbide.

These and still further objects, features and advantages of the present invention will become apparent upon consideration of the following detailed disclosure.

DESCRIPTION OF THE PREFERRED EMBODIMENT

The invention will be illustrated by, but is not intended to be limited to, the following description and examples.

EXAMPLE I

78% by weight hydroxyl terminated polybutadiene (HTPB) and 22% by weight dimeryl diisocyanate (DDI) are thoroughly mixed and then degassed. The composite is then cured at 50° C. for 24 hours. This fuel composition is used as standard against which the other compositions containing additives of the present invention are compared with. Other fuel compositions were prepared under similar conditions and in similar fashion. HTPB and DDI are mixed in the ratio of 78-22 by weight percent to form a composite and various additives singly or a mixture thereof are then added to the composite in a weight percent ratio corresponding to the weight of HTPB. The amount of curative is not taken in account. The composition containing HTPB, DDI and the additive is then degassed and cured at 50° C. for 24 hours.

The examples 2 to 22 are prepared containing HTPB with various proportions of additives as shown in Table I.

TABLE I

| Example | | | | |
|---|---|---|---|---|
| 1 | | 100% HTPB | | |
| 2 | 5% AP | 95% HTPB | | |
| 3 | 10% AP | 90% HTPB | | |
| 4 | 15% AP | 85% HTPB | | |
| 5 | 5% Al | 95% HTPB | | |
| 6 | 13% Al | 87% HTPB | | |
| 7 | 23% Al | 77% HTPB | | |
| 8 | 31% Al | 69% HTPB | | |
| 9 | 40% Al | 60% HTPB | | |
| 10 | 45% Al | 55% HTPB | | |
| 11 | 50% Al | 50% HTPB | | |
| 12 | 55% Al | 45% HTPB | | |
| 13 | 5% Mg | 95% HTPB | | |
| 14 | 10% Mg | 15% Al | 25% $B_4C$ | 50% HTPB |
| 15 | 5% Mg | 5% AP | 30% $B_4C$ | 60% HTPB |
| 16 | 5% Mg | 30% $B_4C$ | 65% HTPB | |
| 17 | 10% Mg | 30% $B_4C$ | 60% HTPB | |
| 18 | 15% Mg | 30% $B_4C$ | 55% HTPB | |
| 19 | 20% Mg | 30% $B_4C$ | 50% HTPB | |
| 20 | 35% Mg | 35% $B_4C$ | 30% HTPB | |
| 21 | 15% $B_4C$ | 85% HTPB | | |
| 22 | 30% $B_4C$ | 70% HTPB | | |

The physical properties of these additives used are as follows:

| Ammonium Perchlorate (AP) | |
|---|---|
| Average particle size | 50 microns |
| Density | 1.53 g/cm$^3$ |
| **Properties of Aluminum Powder (Valley Metallurgical Co. H-5)** | |
| Test required | 32 Test values obtained |
| Material volatile at 105° C. | 0.006% |
| Oil and grease | 0.002% |
| Iron (as Fe) | 0.13% |
| Free metallic aluminum | 99.0% |
| Average particle size (Fisher subsieve sizer) | 5.4 μm |
| Tap density | 1.53 g/ml |
| Particle shape | spherical |
| **Properties of $B_4C$ (Carborundum 800F).** | |
| Particle size | 20 μm and finer |
| Particle shape | Angular |
| Percent boron, wt. % | >76 |
| Particle size median | 4 microns |
| Max 1% | 20 microns |

Mg Powder

Magnesium powder used is known as Granulation No. 16 (nominal mesh size 200-325 and has 65-70 micron diameter. It meets the specification of MIL-M-382-C(A.R.) Aug. 10, 1978).

| Fuel Ingredients | | | | |
|---|---|---|---|---|
| | | Density | Heat of Combustion | |
| Ingredient | Formula | g/cm$^3$ | kcal/g | kcal/cm$^3$ |
| HTPB/DDI | $C_4H_6O_{0.15}$ | 0.92 | 10.16 | 9.34 |
| AP | $NH_4ClO_4$ | 1.95 | 0.32 | 0.62 |
| Mg | Mg | 1.74 | 6.01 | 10.46 |
| Al | Al | 2.70 | 7.41 | 20.0 |
| $B_4C$ | $B_4C$ | 2.50 | 12.235 | 30.58 |

Tests were conducted on the cured compositions of these examples and tabulated as shown in Table II.

The comparison shows that aluminum, magnesium, and boron carbide, alone or in combination with each other when added to HTPB binder and DDI curative systems improve the performance of ramjet solid fuel. More particularly the combination of Mg and $B_4C$ when added to HTPB and cured improves the performance of the fuel significantly.

TABLE II

PERFORMANCE OF EXPERIMENTAL SOLID RAMJET FUELS

| Example | FUEL COMPOSITION (wt %) | Combustion Efficiency ($\eta$) | $\Phi^a$ | Density (gm/cc) | $\Delta Hc^b$ k cal/gm | $\Delta Hc$ K cal/cm$^3$ | Performance Relative to HTPB[c] |
|---|---|---|---|---|---|---|---|
| 1 | HTPB | .76 | .85 | 0.92 | 10.16 | 9.347 | 1.00 |
| 2 | 5% AP 95% HTPB | .81 | .85 | 0.94 | 9.668 | 9.088 | 1.00 |
| 3 | 10% AP 90% HTPB | .786 | 1.17 | 0.971 | 9.176 | 8.910 | 0.98 |
| 4 | 15% AP 85% HTPB | .794 | 1.27 | 0.999 | 8.684 | 8.675 | 0.97 |
| 5 | 5% Al 95% HTPB | .74 | .85 | 0.95 | 10.02 | 9.519 | 0.99 |
| 6 | 13% Al 87% HTPB | .76 | .85 | 1.01 | 9.80 | 9.898 | 1.06 |
| 7 | 23% Al 77% HTPB | .71 | .85 | 1.08 | 9.53 | 10.292 | 0.95 |
| 8 | 31% Al 69% HTPB | .71 | .85 | 1.16 | 9.31 | 10.800 | 1.08 |
| 9 | 40% Al 60% HTPB | .75 | .85 | 1.25 | 9.06 | 11.325 | 1.19 |
| 10 | 45% Al 55% HTPB | .636 | .88 | 1.308 | 8.927 | 11.677 | 1.04 |
| 11 | 50% Al 50% HTPB | .674 | 1.03 | 1.42 | 8.790 | 12.482 | 1.18 |
| 12 | 55% Al 45% HTPB | .564 | .97 | 1.443 | 8.653 | 12.486 | 0.99 |
| 13 | 5% Mg 95% HTPB | .73 | .85 | 0.94 | 9.947 | 9.350 | 0.96 |
| 14 | 10% Mg 15% Al 25% $B_4C$ 50% HTPB | .779 | 1.19 | 1.322 | 9.842 | 13.011 | 1.42 |
| 15 | 5% Mg 5 AP 30% $B_4C$ 60% HTPB | .656 | 1.19 | 1.210 | 10.077 | 12.193 | 1.12 |
| 16 | 5% Mg 30% $B_4C$ 65% HTPB | .69 | .85 | 1.17 | 10.570 | 12.367 | 1.20 |
| 17 | 10% Mg 30% $B_4C$ 60% HTPB | .727 | .906 | 1.205 | 10.356 | 12.479 | 1.28 |
| 18 | 15% Mg 30% $B_4C$ 55% HTPB | .689 | .98 | 1.244 | 10.144 | 12.619 | 1.22 |
| 19 | 20% Mg 30% $B_4C$ 50% HTPB | .740 | 1.06 | 1.285 | 9.931 | 12.761 | 1.33 |
| 20 | 35% Mg 35% $B_4C$ 30% HTPB | .794 | .80 | 1.499 | 9.397 | 14.086 | 1.57 |
| 21 | 15% $B_4C$ 85% HTPB | .64 | .85 | 1.02 | 10.470 | 10.679 | 0.96 |
| 22 | 30% $B_4C$ 70% HTPB | .61 | .85 | 1.13 | 10.781 | 12.183 | 1.04 |

[a]Equivalence ratio (Stoichiometric air-to-fuel ratio ÷ Actual air-to-fuel ratio).
[b]Net heat of combustion

[c] $\frac{K\ cal/cm^3 \times \eta}{K\ cal/cm^3_{HTPB} \times \eta_{HTPB}}$

Examples 16 to 20 indicate that the performance of HTPB fuel is substantially increased when it is loaded with up to 116 parts by weight of Mg and up to 116 parts by weight of $B_4C$ relative to 100 parts by weight of HTPB. Examples 14 and 15 indicate that improved results are obtained when Al is also added with weight HTPB-Mg-$B_4C$ mixture. Thus HTPB fuel could be loaded with weight percentages of Al, Mg, and $B_4C$ corresponding to the weight of HTPB, in quantities of up to 30 percent Al, up to 20 percent Mg and up to 50 percent $B_4C$ in relation to HTPB.

Thus the invention demonstrates that the volumetric heating values of HTPB can be increased significantly by the addition of certain metals and compounds. The high volumetric heating value fuels of the present invention have the potential not only for increasing missile range but also for reducing missile length or diameter for a given range when used in place of lower heating value fuels.

Though DDI has been used as curative for HTPB in the above examples, any other suitable curative will produce substantially the same results.

It should therefore be appreciated that the present invention as described achieves its intended purpose by providing superior ramjet fuel compositions which exhibit:

(1) suitable physical properties over a wide temperature range, (2) long-term storage stability, (3) low toxicity, (4) a very low degree of manufacturing and handling hazard, (5) high volumetric heats of combustion, (6) ease of ignition, and (7) high combustion efficiencies.

Obviously many modifications and variations of the present invention are possible in light of the above teachings. It is therefore to be understood that within the scope of the appended claims the invention may be practiced otherwise than as specifically described.

We claim:

1. A solid ramjet fuel consisting essentially of hydroxyl terminated polybutadiene, magnesium and boron carbide wherein the weight percentages of said fuel are from 5–35% Mg, from 30–35% $B_4C$ and from 30–65% HTPB.

2. The solid ramjet fuel of claim 1, wherein the weight percentages of said fuel are about 35% magnesium, about 35% boron carbide and about 30% HTPB.

3. A solid ramjet fuel consisting essentially of hydroxyl terminated polybutadiene (HTPB), magnesium, aluminum and boron carbide wherein the weight percentages of said fuel are about 10% magnesium, about 15% aluminum, about 25% boron carbide and about 50% HTPB.

* * * * *